US005791991A

United States Patent [19]

Small

[11] Patent Number: 5,791,991

[45] Date of Patent: Aug. 11, 1998

[54] INTERACTIVE CONSUMER PRODUCT PROMOTION METHOD AND MATCH GAME

[76] Inventor: Maynard E. Small, 1205 San Francisco Tower, 2510 Grand Ave., Kansas City, Mo. 64108

[21] Appl. No.: 559,798

[22] Filed: Nov. 15, 1995

[51] Int. Cl.[6] ..... A63F 3/06

[52] U.S. Cl. ..... 463/41

[58] Field of Search ..... 463/40, 41, 42; 395/762, 774, 155

[56] References Cited

U.S. PATENT DOCUMENTS

| | | | |
|---|---|---|---|
| 4,285,520 | 8/1981 | Small . | |
| 4,509,759 | 4/1985 | Small . | |
| 4,619,457 | 10/1986 | Small . | |
| 4,711,454 | 12/1987 | Small . | |
| 4,775,155 | 10/1988 | Lees . | |
| 5,074,566 | 12/1991 | Desbiens . | |
| 5,118,109 | 6/1992 | Gumina . | |
| 5,139,270 | 8/1992 | Gernhofer . | |
| 5,193,815 | 3/1993 | Pollard . | |
| 5,572,643 | 11/1996 | Judson | 395/155 |

OTHER PUBLICATIONS

National Product "Check Out"Game, Inc.'s 1966 National Product Check Out Game.

Pennsylvania Lottery 1992 game tickets with attached coupons.

Missouri Lottery 1994 Bingo game cards.

*The New York Daily News* advertisement for "Cross–Out" Product Picture Game.

*The Detroit Times*, Jun. 9k 1956 advertisement for L. L. Bugg's Product Picture Game.

*Primary Examiner*—George Manuel

*Attorney, Agent, or Firm*—Litman, McMahon and Brown, L.L.C.

[57] ABSTRACT

An interactive consumer product promotion method and match game includes a database which is accessed for an information screen displayed on an interactive electronic terminal, such as a personal computer, interactive television, in-store kiosk, etc. The displayed information screen typically includes a listing of popular consumer product categories, such as "Detergents"; "Cereals"; "Motor Oil"; "Cookies"; "Crackers"; etc. along with a matrix of spaces representing a match game such as Bingo or Keno. In each space in the displayed matrix a symbol is displayed. The game is played by comparing selected consumer product categories with preselected spaces on the matrix to detect matches and corresponding prizes. Coupons and/or rebate offers for products with the selected categories are downloaded for printing by the consumer. A personalized rebate form can be printed which allows the consumer to collectively submit multiple register receipts and/or UPC codes for selected products, via mail or electronic scanning, in order to secure a single combined electronic or mailed rebate payment.

30 Claims, 8 Drawing Sheets

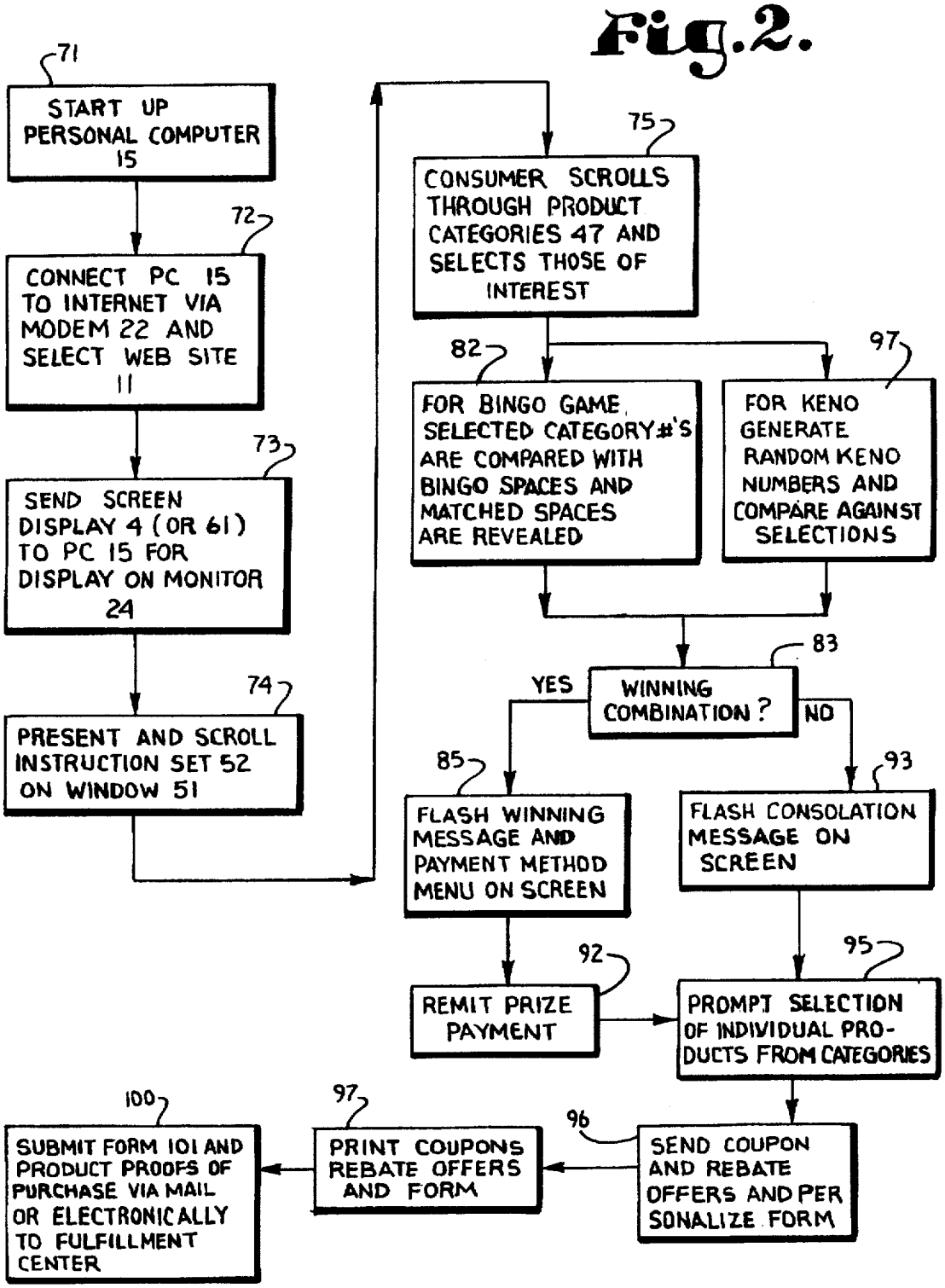
Fig.2.
71
START UP PERSONAL COMPUTER 15
72
CONNECT PC 15 TO INTERNET VIA MODEM 22 AND SELECT WEB SITE 11
73
SEND SCREEN DISPLAY 4 (OR 61) TO PC 15 FOR DISPLAY ON MONITOR 24
74
PRESENT AND SCROLL INSTRUCTION SET 52 ON WINDOW 51
75
CONSUMER SCROLLS THROUGH PRODUCT CATEGORIES 47 AND SELECTS THOSE OF INTEREST
82
FOR BINGO GAME, SELECTED CATEGORY#'S ARE COMPARED WITH BINGO SPACES AND MATCHED SPACES ARE REVEALED
97
FOR KENO GENERATE RANDOM KENO NUMBERS AND COMPARE AGAINST SELECTIONS
83
WINNING COMBINATION ?
YES
NO
85
FLASH WINNING MESSAGE AND PAYMENT METHOD MENU ON SCREEN
93
FLASH CONSOLATION MESSAGE ON SCREEN
92
REMIT PRIZE PAYMENT
95
PROMPT SELECTION OF INDIVIDUAL PRODUCTS FROM CATEGORIES
96
SEND COUPON AND REBATE OFFERS AND PERSONALIZE FORM
97
PRINT COUPONS REBATE OFFERS AND FORM
100
SUBMIT FORM 101 AND PRODUCT PROOFS OF PURCHASE VIA MAIL OR ELECTRONICALLY TO FULFILLMENT CENTER

FIG. 3

CASHBACK BINGO

| | | | | |
|---|---|---|---|---|
| $ | $ | $ | $ | $ |
| $ | $ | $ | $ | $ |
| $ | $ | *CASHBACK* FREE SPACE | $ | $ |
| $ | $ | $ | $ | $ |
| $ | $ | $ | $ | $ |

1. Air Fresheners
2. Auto Products
3. Bathroom Tissue
4. Candy
5. Cat Food
6. Cereals
7. Cheese
8. Coffee
9. Crackers
10. Dental Care
11. Detergents Laundry
12. Diapers
13. Dog Foods
14. Film
15. Hosiery
16. Ice Cream
17. Juices, Frozen
18. Light Bulbs
19. Pain Remedies
20. Pasta
21. Pizza
22. Plastic Wrap
23. Shampoo
24. Snacks
25. Soaps, Bath
26. Soda
27. Soup
28. Trash Bags
29. Veggies, Canned
30. Vitamins PLEASE SELECT EIGHT PRODUCT CATEGORIES FOR WHICH YOU WOULD LIKE TO RECEIVE DISCOUNT AND/OR REFUND/REBATE INFORMATION. AS EACH PRODUCT CATEGORY IS SELECTED, PLEASE OBSERVE THE BINGO CARD ON YOUR SCREEN

PLAY THE GAME!

FIG. 4

CASHBACK BINGO

| | | | | |
|---|---|---|---|---|
| 6 CEREALS | $ | $ | $ | $ |
| $ | 18 LIGHT BULBS | $ | $ | $ |
| $ | $ | *CASHBACK* FREE SPACE | $ | $ |
| $ | $ | $ | 11 DETERGENTS LAUNDRY | $ |
| $ | $ | $ | $ | 5 CAT FOOD |

1. Air Fresheners
2. Auto Products
3. Bathroom Tissue
4. Candy
5. Cat Food
6. Cereals
7. Cheese
8. Coffee
9. Crackers
10. Dental Care
11. Detergents, Laundry
12. Diapers
13. Dog Foods
14. Film
15. Hosiery
16. Ice Cream
17. Juices, Frozen
18. Light Bulbs
19. Pain Remedies
20. Pasta
21. Pizza
22. Plastic Wrap
23. Shampoo
24. Snacks
25. Soaps, Bath
26. Soda
27. Soup
28. Trash Bags
29. Veggies, Canned
30. Vitamins PLEASE CHOOSE ONE THE FOLLOWING PAYMENT METHODS FOR YOUR PRIZE BY HIGHLIGHTING AND HITTING "ENTER"

CHECK BY RETURN MAIL _____

ELECTRONIC FUNDS TRANSFER TO _____ BANK

GIFT CERTIFICATE TO ABC DEPT. STORE _____

YOU HAVE JUST WON $1,000!!

FIG. 5

CASHBACK BINGO

| | | | | |
|---|---|---|---|---|
| 6 CEREALS | 17 JUICES FROZEN | 16 ICE CREAM | 7 CHEESE | 8 COFFEE |
| 3 BATHROOM TISSUE | 18 LIGHT BULBS | 4 CANDY | 28 TRASH BAGS | 23 SHAMPOO |
| 14 FILM | 29 VEGGIES CANNED | *CASHBACK* FREE SPACE | 15 HOSIERY | 13 DOG FOODS |
| 1 AIR FRESHNERS | 24 SNACKS | 26 SODA | 11 DETERGENTS LAUNDRY | 2 AUTO PRODUCTS |
| 20 PASTA | 9 CRACKERS | 27 SOUP | 22 PLASTIC WRAP | 5 CAT FOOD |

1. Air Fresheners
2. Auto Products
3. Bathroom Tissue
4. Candy
5. Cat Food
6. Cereals
7. Cheese
8. Coffee
9. Crackers
10. Dental Care
11. Detergents Laundry
12. Diapers
13. Dog Foods
14. Film
15. Hosiery
16. Ice Cream
17. Juices, Frozen
18. Light Bulbs
19. Pain Remedies
20. Pasta
21. Pizza
22. Plastic Wrap
23. Shampoo
24. Snacks
25. Soaps, Bath
26. Soda
27. Soup
28. Trash Bags
29. Veggies, Canned
30. Vitamins

THANKS FOR TRYING!

BETTER LUCK NEXT TIME!

ENJOY YOUR SAVINGS!!

FIG. 6

CASHBACK KENO

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |
| 81 | 82 | 83 | 84 | 85 | 86 | 87 | 88 | 89 | 90 |
| 91 | 92 | 93 | 94 | 95 | 96 | 97 | 98 | 99 | 100 |

1. Air Fresheners
2. Auto Products
3. Bathroom Tissue
4. Candy
5. Cat Food
6. Cereals
7. Cheese
8. Coffee
9. Crackers
10. Dental Care
11. Detergents Laundry
12. Diapers
13. Dog Foods
14. Film
15. Hosiery
16. Ice Cream
17. Juices, Frozen
18. Light Bulbs
19. Pain Remedies
20. Pasta
21. Pizza
22. Plastic Wrap
23. Shampoo
24. Snacks
25. Soaps, Bath
26. Soda
27. Soup
28. Trash Bags
29. Veggies, Canned
30. Vitamins PLEASE SELECT EIGHT PRODUCT CATEGORIES FOR WHICH YOU WOULD LIKE TO RECEIVE DISCOUNT AND/OR REFUND/REBATE INFORMATION. AFTER ALL PRODUCT CATEGORIES ARE SELECTED, PLEASE OBSERVE THE KENO GAME ABOVE TO

PLAY THE GAME!!

FIG. 7

CASHBACK KENO

| | | | | | | | | | |
|---|---|---|---|---|---|---|---|---|---|
| **1** | 2 | 3 | 4 | 5 | 6 | 7 | 8 | **9** | 10 |
| **11** | 12 | 13 | 14 | 15 | 16 | 17 | 18 | 19 | 20 |
| 21 | 22 | 23 | **24** | 25 | **26** | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | **63** | 64 | 65 | **66** | 67 | 68 | **69** | 70 |
| 71 | 72 | 73 | 74 | 75 | 76 | 77 | 78 | 79 | 80 |
| 81 | 82 | 83 | 84 | 85 | 86 | 87 | **88** | 89 | 90 |
| 91 | 92 | 93 | 94 | 95 | 96 | 97 | 98 | 99 | 100 |

1. Air Fresheners
2. Auto Products
3. Bathroom Tissue
4. Candy
5. Cat Food
6. Cereals
7. Cheese
8. Coffee
9. Crackers
10. Dental Care
11. Detergents Laundry
12. Diapers
13. Dog Foods
14. Film
15. Hosiery
16. Ice Cream
17. Juices, Frozen
18. Light Bulbs
19. Pain Remedies
20. Pasta
21. Pizza
22. Plastic Wrap
23. Shampoo
24. Snacks
25. Soaps, Bath
26. Soda
27. Soup
28. Trash Bags
29. Veggies, Canned
30. Vitamins PLEASE CHOOSE ONE THE FOLLOWING PAYMENT METHODS FOR YOUR PRIZE BY HIGHLIGHTING AND HITTING "ENTER"

CHECK BY RETURN MAIL _____

ELECTRONIC FUNDS TRANSFER TO _____ BANK

GIFT CERTIFICATE TO ABC DEPT. STORE _____

YOU HAVE JUST WON $50!!

INTERACTIVE CONSUMER PRODUCT PROMOTION METHOD AND MATCH GAME

BACKGROUND OF THE INVENTION

I. Field of The Invention

The present invention relates to an interactive product promotion method and a match game associated therewith. More particularly, the product promotion method includes accessing a database from a remote interactive electronic display via the Internet or other electronic link. A screen display of a list of product categories along with a representation of the match game is accessed and displayed on the interactive display. Selected categories are used to generate printed product promotion information at the site of the interactive display as well as being used in the match game to determine instant winners.

II. Description of The Related Art

In marketing of consumer products, particularly in the United States, it has long been common for manufacturers to offer discount coupons, either by direct mail or by inserts in newspapers and magazines. Such coupons can be used while purchasing the product to receive a direct price reduction from the retail merchant. A disadvantage of this approach is the requirement for the consumer to clip and maintain a coupon file, accounting for expiration dates, differences among vendors, etc. and to be able to access the correct coupon at the point of sale. It takes a somewhat dedicated shopper to take full advantage of this type of discount coupon, thus limiting the effective advertising audience for the manufacturers. In addition, the merchant has the inconvenience and cost associated with collecting the coupons and forwarding them to the manufacturers to, in turn, recoup the discounts.

Another common marketing approach has been to attach refund offers directly to the product, or to display them alongside the product on a retail shelf, which refunds can be mailed in to the manufacturer, along with a proof of purchase, to get a refund or rebate on the product. Some retail merchants provide a central bulletin board where all of the rebate forms are placed, requiring interested consumers to look through all of the forms to locate the one or ones in which they are interested. In addition to this time consuming search for relevant refund offers, there are several additional disadvantages of this rebate approach. Members of "discount or rebate clubs" will often take an entire booklet of refund forms from a display for trade or sale within the club, thus totally disrupting the manufacturer's promotional scheme. The forms must be printed and distributed by the manufacturers to participating retailers, which represents a significant ongoing cost. Often manufacturers can supply only the largest retailers with refund forms, which diminishes the effectiveness of promotions by virtually eliminating small merchants from the marketing effort. Consumers often do not know of the existence of the refund until he or she actually examines the product or the display in the store. Furthermore, since rebates are typically for nominal amounts, such as $.50 to $2.00, for example, the postage costs to mail in these forms for a rebate are often prohibitive if the consumer is asked to bear them or, if the manufacturer uses prepaid postage, the postage will dramatically increase the promotional costs. The requirement to hand print many envelopes, one for each offer and to send in a separate proof of purchase, typically a store receipt, with each offer causes additional inconvenience. Lastly, the physical distribution of coupons or rebate offers by free standing inserts, newspapers, magazines and direct mail offers uses substantial valuable resources, e.g. paper, ink, electricity, petroleum products and other chemicals. Furthermore, estimates are that fewer than 5 percent of unsolicited coupons and rebate offers are ever redeemed.

Yet another marketing strategy, more popular in the 1950's and 1960's, was the trade stamp approach, in which certain participating retail merchants gave trading stamps to customers at the point of sale. The customers then placed the stamps into books and used the books of stamps to redeem prizes selected from catalogs at stamp redemption centers. This type of promotion is more retail merchant oriented than product oriented, since stamps were typically awarded for all purchases made from the participating merchant. Thus, manufacturers did not usually use trading stamps for specific product promotion. Furthermore, the logistics of maintaining stamp booklets and the requirement to physically exchange the filled booklets at a redemption center were unduly burdensome to the ultimate consumer.

Meanwhile, match games of chance, such as Bingo and Keno are becoming more and more popular world wide, and particularly in the United States. Bingo parlors are proliferating, both as charity fund raisers and as legal for-profit ventures. Also, currently at least 30 state and provincial lotteries have adopted a bingo card format for their instant prize winner lottery cards. These cards are typically "Scratcher Bingo" games in which a caller's card and as many as four separate bingo squares are displayed. The player scratches off the play spaces which match numbers on the caller's card, attempting a traditional bingo match of vertical, horizontal or diagonal lines or four corners. The game cards can take a full 10 to 15 minutes to complete and are popular due to the hands-on participation required. Typically a player has a chance to win multiple prizes from a single card via the multiple bingo squares. Keno, although less well known, is proliferating as well with the expansion of legal gambling facilities.

It is apparent that, with recent proliferation in personal computers, the availability of on-line services and the Internet, and the increasing popularity of match games, such as Bingo and Keno, a more desirable and convenient method of promoting the sale of consumer products should be developed. Such a promotion method should limit, or even eliminate, the requirement for paper coupons and should allow manufacturers an opportunity to promote specific products without altering product containers or attaching special coupons to the products or store shelves. The method should also allow consumers to personally select product categories and products within the selected categories for refund or discount information in advance of their shopping trip, and, to be effective, the method should generate consumer interest and excitement by the use of a match game format for the selected product categories. Finally, the method should save valuable natural resources by specifically targeting rebate and coupon offers only to those consumers who actively solicit such offers.

SUMMARY OF THE INVENTION

The present invention is an interactive consumer product promotion method and match game in which a database is accessed for an information screen which is displayed on an interactive electronic terminal, such as a personal computer, interactive television, in-store kiosk, etc. The displayed information screen typically includes a listing of popular consumer product categories, such as "Detergents"; "Cereals"; "Motor Oil"; "Cookies"; "Crackers"; etc. An instruction set informs the consumer to select a predetermined number of categories for which he or she desires information on available refunds or discounts. Simultaneously displayed on the screen is a matrix of spaces representing a match game such as Bingo or Keno. In the case of Bingo, a Bingo card matrix is displayed and in each space in the displayed matrix a covering symbol is displayed, or, alternatively, a mosaic picture or message can be displayed by combining multiple spaces. A computer associated with the database randomly generates a map of product categories which are associated with respective individual spaces but which are "hidden" by the covering symbols or mosaic. After all of the product categories are selected by the consumer, the database checks each selected category to determine if it is one of the ones randomly mapped to the matrix of spaces. If the selected category is one of those mapped to the matrix of spaces, that particular space is revealed as a match by displaying, for example, the product category number in the space. In the case of Keno, the screen display includes a representation resembling a conventional Keno number field. Selected product category numbers are then used as Keno numbers against a randomly generated sampling of the Keno number field.

In either game format, the participating consumer is directed to choose a certain number of categories, eight out of 100, for example, and each selection is compared against the Bingo matrix or the Keno field for matches. In the case of a Bingo game, if the selected categories match to make a complete line horizontally, vertically or diagonally, an "X" formed by two diagonals or all four corners are filled, the consumer wins an "instant" prize. A "free" space will typically be included as one of the spaces. The odds of winning can be decreased at any time by increasing the number of free spaces. In the case of a Keno format, if a certain number of matches are made anywhere on the number field, the player is a winner. Meanwhile, for each product category selected, the player is prompted to select one or more specific products from a category menu with product promotions, coupons, or refund offers being downloaded to the interactive electronic display for each selected product. The product promotions, coupons, or refund offers can be immediately printed or stored for later use by the consumer. In addition, in the event of refund promotions, a custom personalized form can be printed which allows the consumer to submit register receipts, UPC codes or other proofs of purchase for any or all of the selected products in a single envelope in order to secure a single combined electronic funds transfer or mailed refund payment. Alternatively, the form and the proofs of purchase can be electronically scanned into the database.

OBJECTS AND ADVANTAGES OF THE INVENTION

The principle objects and advantages of the invention include: to provide an improved consumer product promotion method including a match game; to provide such a consumer product promotion method in which a consumer accesses a promotion database via an interactive electronic display terminal; to provide such a consumer product promotion method in which a number of product categories are displayed for selection by a consumer; to provide such a consumer product promotion method and match game in which a match game is displayed along with the product categories; to provide such a consumer product promotion method and match game in which the match game can take the form of a Bingo game or a Keno game; to provide such a consumer product promotion method and match game in which individual product categories are associated with corresponding spaces in the match game and product categories selected by the consumer are compared against the associated categories to detect matches; to provide such a match game in which "instant" prizes are awarded depending upon the number and/or the arrangement of matched product categories; to provide such a consumer product promotion method in which personalized discount and/or refund information is made available for storing or printing for selected products in each of the selected product categories; and to provide such a consumer product promotion method and match game which is readily implementable with existing technology, which provides for effective product promotion with minimal expense, and which results in improved efficiency for participating consumer product manufacturers and enhanced interest for consumers.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a sample display screen for the inventive interactive consumer product promotion method and Bingo match game showing matches revealed on the Bingo game which result in an instant winner.

FIG. 5 is a sample display screen for the inventive interactive consumer product promotion method and Bingo match game showing all of the product categories stored at each space in the Bingo matrix and with matched category numbers which do not yield an instant winner.

FIG. 7 is a sample display screen for the inventive interactive consumer product promotion method and Keno match game after all of the product category selections have been made and with the randomly generated Keno numbers highlighted to reveal an instant winner.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
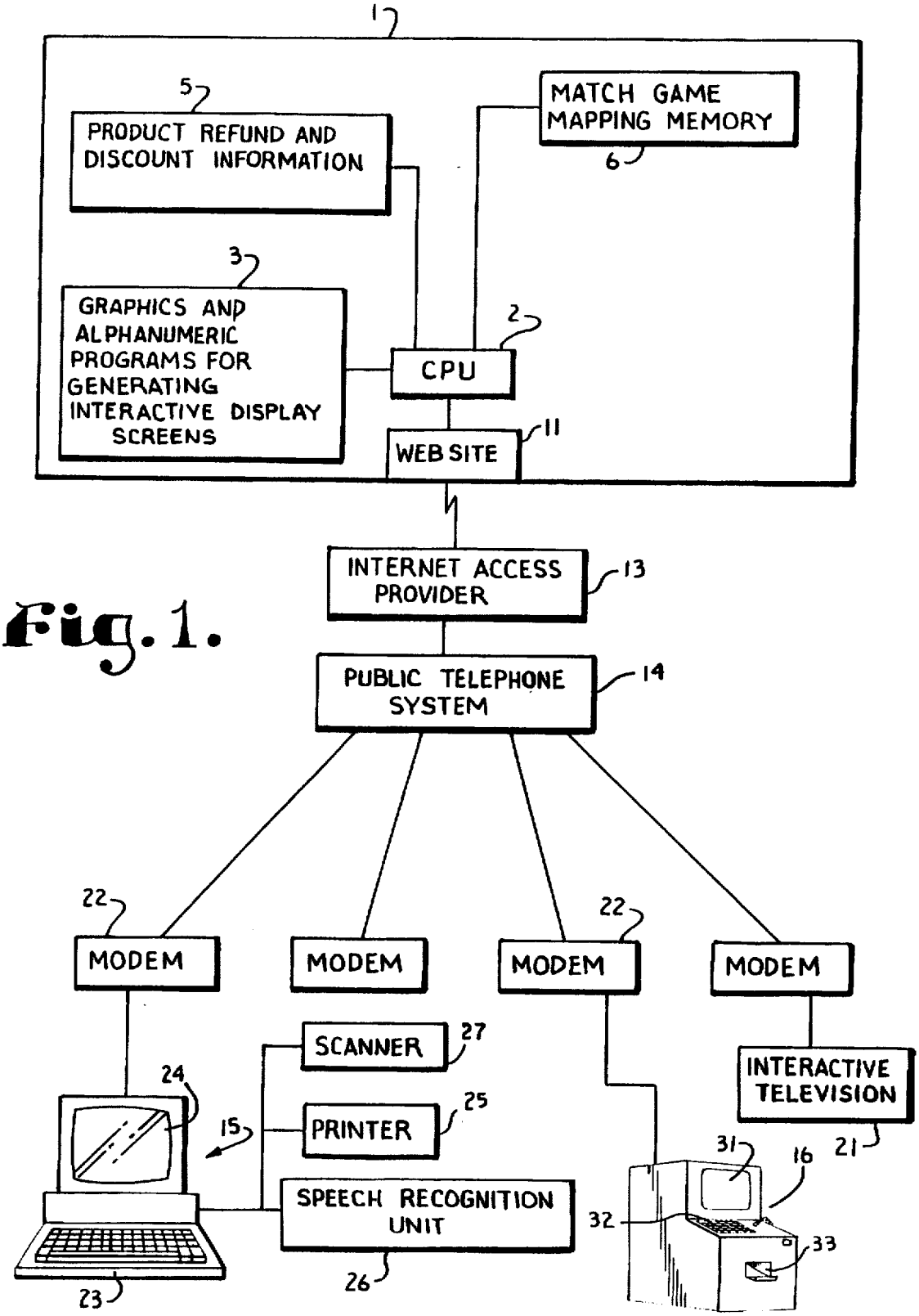
FIG. 1 is a block schematic diagram of an interactive electronic system for implementing the inventive interactive consumer product promotion method and match game.

Referring to FIG. 1, the numeral 1 generally refers to a centralized database for the inventive interactive consumer product promotion method and match game. The database 1 includes a CPU 2 to which are connected graphics and alphanumerics programs 3 suitable for generating an interactive screen display such as the display 4 in FIG. 3. A memory 5 stores consumer product discount and refund information by product category and selected products within each category. A memory 6 stores a match game map in which spaces on a map game matrix are mapped to respective consumer product categories or category numbers. The category numbers for the match game map can be randomly or pseudo-randomly generated by the CPU 2.

The CPU 2 is shown connected as an Internet addressable web site location, as indicated at block 11. Access to the Internet by consumers is provided conventionally via Internet Access Providers or On-line services such as America On-Line, Compuserve, etc., all of which are generally indicated at 13, connected to the public telephone system 14. Integral with the web site 11 can be a series of "hot links" to other web sites of participating manufacturers, retailers, etc. In addition to the internet connection, information can be transmitted from the database 1 to inquiring consumers or manufacturers via electronic mail. An interactive electronic display for accessing the database 1 can take the form of a personal computer 15, an in-store kiosk 16 and/or an interactive television 21, each of which has access to the public telephone system 14 via respective modems 22. The personal computer 15 has a conventional data entry keyboard 23 associated therewith as well as a monitor 24 and a printer 25. An optional speech recognition module 26 can be attached to the personal computer 15 to allow a consumer to input data via voice as an alternative to or in addition to the keyboard 23. An optional scanner 27 can also be attached to the personal computer 15 for scanning in completed rebate forms and proofs of purchase, as will be explained below. The kiosk 16 can include a monitor 31, a keyboard 32, and a printer 33. Data entry with the interactive television 21 can be accomplished in a conventional manner via keypad, light pen, speech recognition unit, etc. (not shown).

I. Bingo Match Game Display Screen

Figure 3:
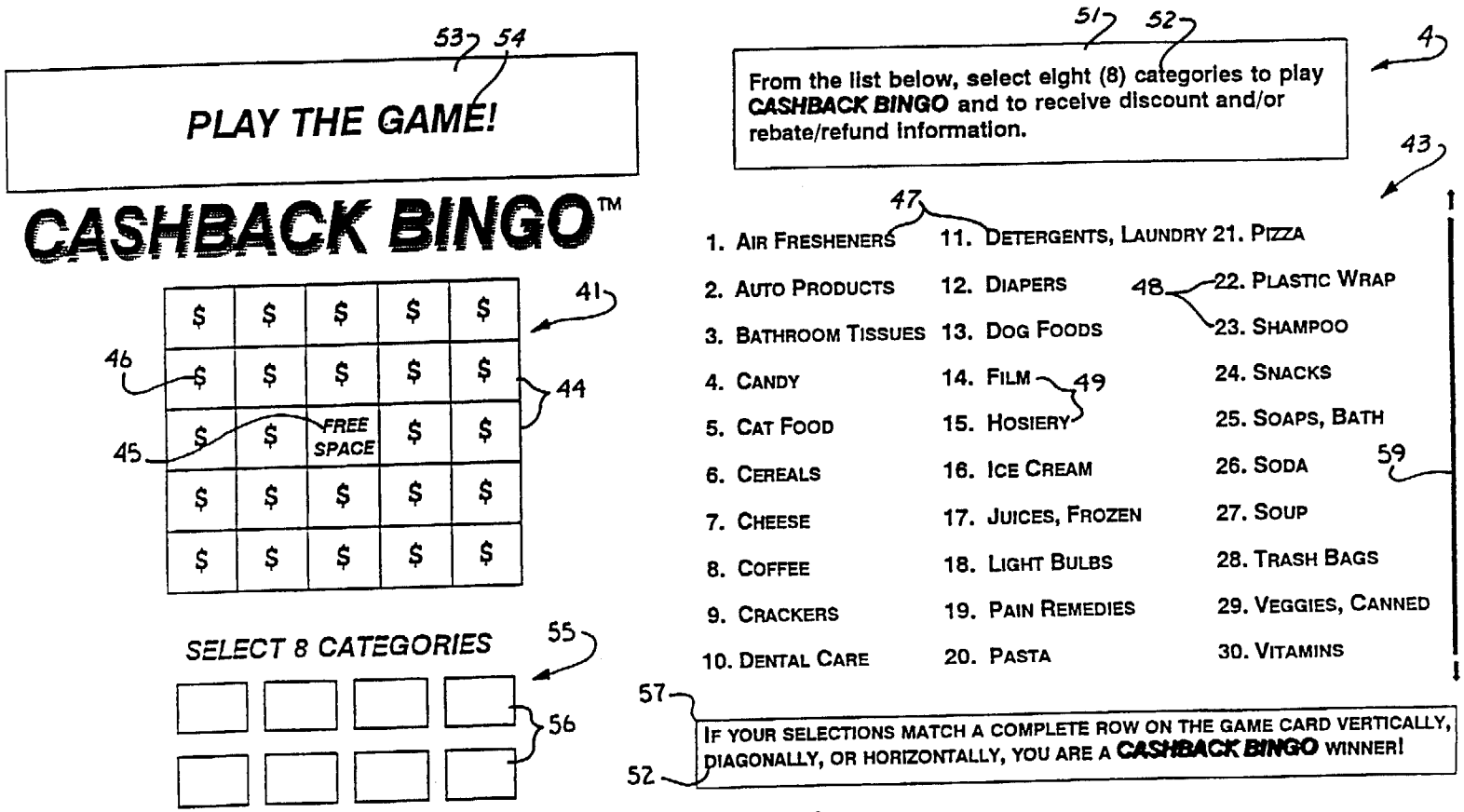
FIG. 3 is a sample initial display screen for the inventive interactive consumer product promotion method and a Bingo match game.

FIG. 3 illustrates an initial screen display 4 for display on the personal computer monitor 24, the kiosk monitor 31 or the interactive television 21. The screen display 4 includes a match game area, illustrated here as a Bingo game 41, and a consumer product category display area 43, as indicated by the scroll arrows 59. The Bingo game 41 is a representation of a conventional Bingo card formed by a matrix of bingo playing spaces 44. One or more of the spaces 44 can be a "FREE SPACE", as shown at 45. FIG. 3 illustrates the Bingo game 41 as it is first accessed by a consumer. Each of the playing spaces 44, with the exception of the "FREE SPACE" 45, is "covered" electronically with a uniform symbol, such as the dollar sign 46. As an alternative, the Bingo game spaces 44 can initially collectively display a collage or mosaic (not shown).

Within the product category display area 43 are displayed a plurality of product categories 47, each of which includes a numerical reference 48 and a category title 49. While 30 categories 47 are illustrated in FIG. 3, it is contemplated that up to 100 or more such categories 47 can be displayed by scrolling the display area 43. An instruction area 51 includes an instruction set 52 for selecting categories 47 and playing the Bingo game 41. A prize window 53 includes a status message 54, such as "PLAY THE GAME!" or a similar invitation. A selected category display area 55 is provided beneath the Bingo game 41 with individual windows 56 for displaying the numerals 48 (FIG. 4) of the categories 47 as each category is selected. An additional information window 57 can be provided for an explanation 58 for how an instant prize can be won. Scroll arrows 59 can be displayed for scrolling the category window 43.

II. Keno Match Game Display Screen

Figure 6:
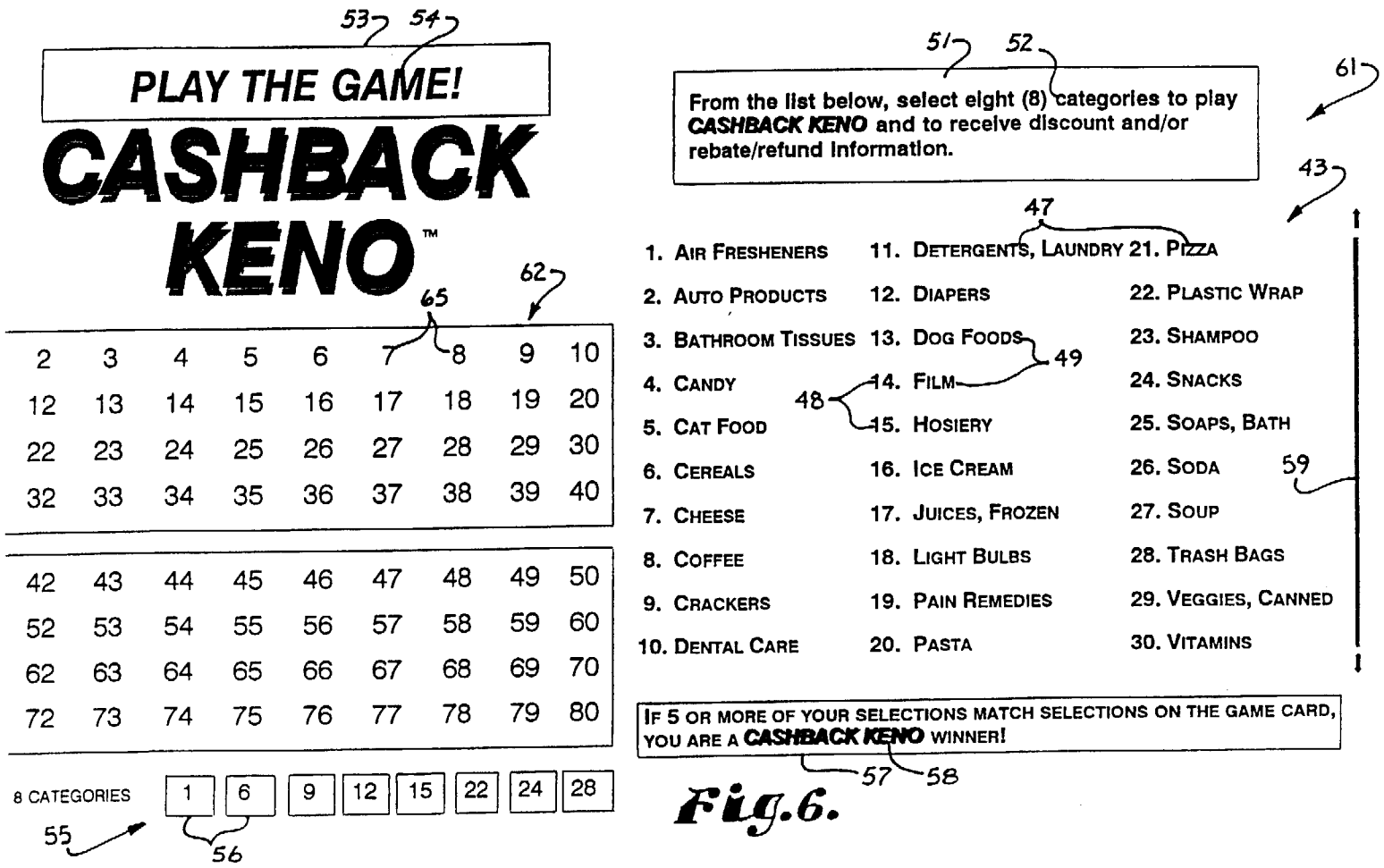
FIG. 6 is a sample initial display screen for the inventive interactive consumer product promotion method and a Keno match game.
Figure 8:
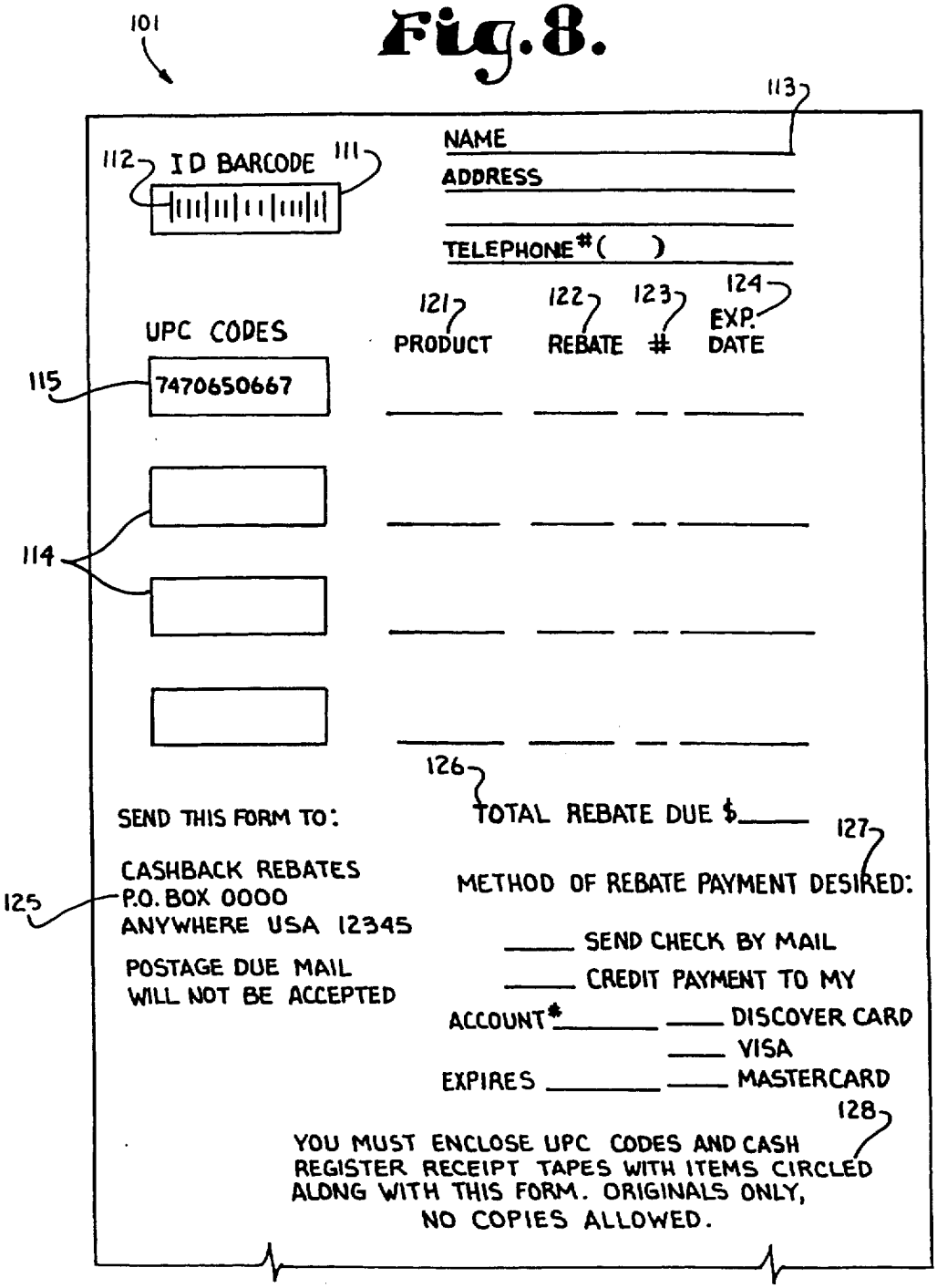

FIG. 6 illustrates an alternative initial screen display 61 for display on the personal computer monitor 24, the kiosk monitor 31 or the interactive television 21. The screen display 61 includes a match game area, illustrated here as a Keno game 62, and a consumer product category display area 43. The product category display area 43 is identical to that illustrated in FIGS. 3–5, with a plurality of product categories 47, each of which includes a numerical reference 48 and a category title 49. Again, while 30 categories 47 are illustrated in FIG. 6, it is contemplated that up to 100 or more such categories 47 can be displayed by scrolling the display area 43 as indicated by scroll arrows 59. An instruction area 51 includes an instruction set 52 for selecting categories 47 and playing the Keno game 62. The Keno game 62 is a Keno number matrix with a plurality of numbers 65, here shown as 1–80. Alternatively, 100 or more numbers 65 can be displayed in the Keno game 62, with the number of Keno numbers matching the number of product categories 47. Thus, the numbers 65 correspond to the numerical references 48 of the product categories 47. As in the Bingo version, a prize window 53 includes a status message 54, such as "PLAY THE GAME!" or a similar invitation, a selected category display area 55 is provided beneath the Keno game 62 with individual windows 56 for displaying the numerals 48 of the categories 47 as each category is selected. An additional information window 57 can be provided for an explanation 58 for how an instant prize can be won.

III. Consumer Product Promotion Method

Figure 2:
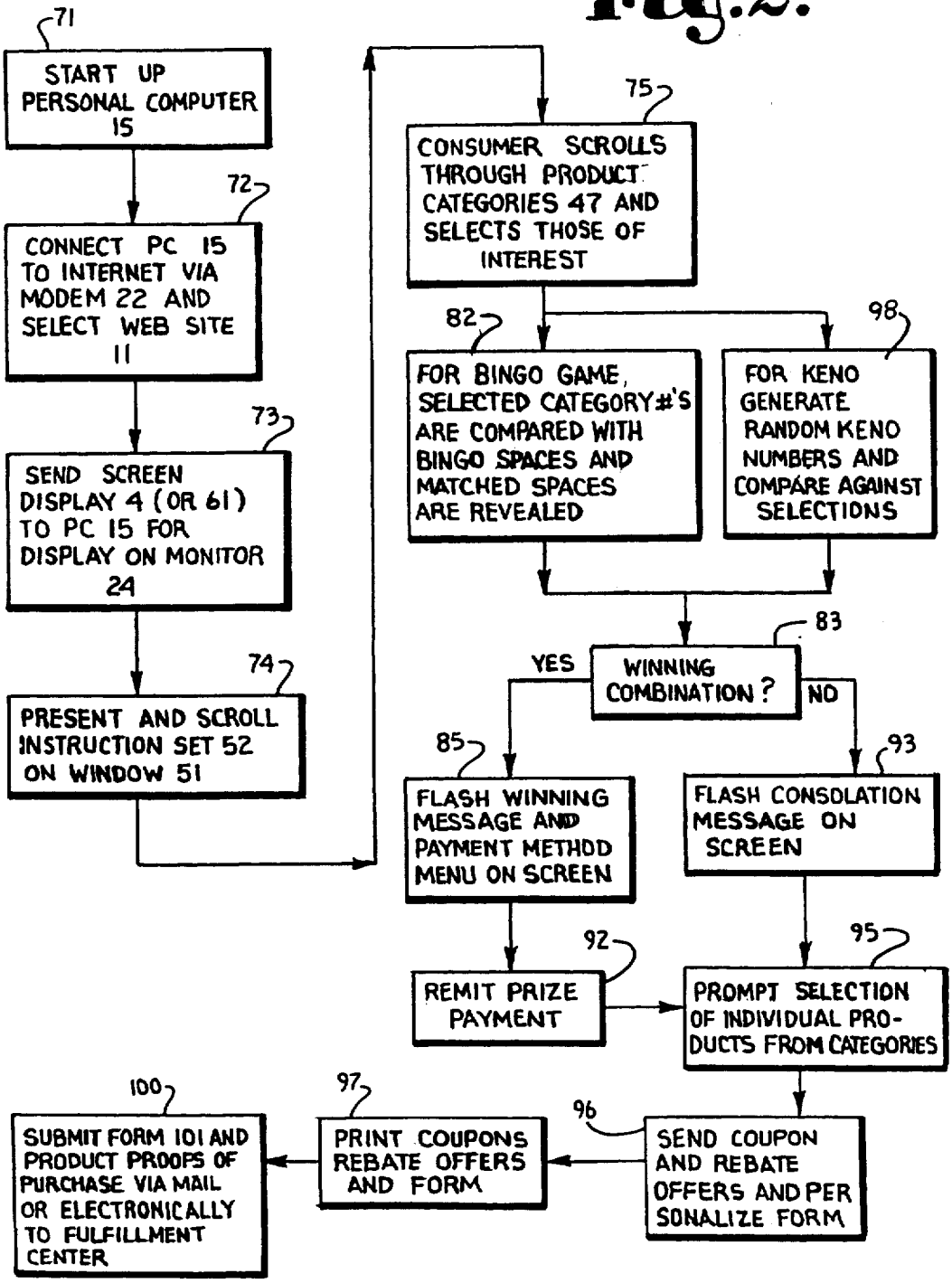
FIG. 2 is a flow chart of the procedures a consumer follows in selecting product categories and playing the match game.

With reference to FIG. 2, the Product Promotion Method will be described step-by-step with reference to the Bingo Game of FIGS. 3–5. At step 71, a consumer has access to an interactive electronic display, such as the personal computer 15, the kiosk 16 or the interactive television 21. For purposes of this discussion, it is assumed that the personal computer 15 is being used. At block 72, the consumer connects the personal computer 15 to the Internet via the Internet Service Provider 13 and selects the web site address 11 of the database 1 via the CPU 2. At block 73, in response, the CPU 2 sends the screen display 4 (or 61) to the monitor 24 of the personal computer 15. At block 74, the consumer reads the instruction set 52, which, when scrolled through, can read somewhat as follows:

PLEASE SELECT EIGHT PRODUCT CATEGORIES FOR WHICH YOU WOULD LIKE TO RECEIVE DISCOUNT AND/OR REFUND/REBATE INFORMATION. AS EACH PRODUCT CATEGORY IS SELECTED, THE CATEGORY NUMBER WILL BE DISPLAYED UNDER THE BINGO GAME CARD ON YOUR SCREEN. ONCE YOU HAVE SELECTED ALL EIGHT CATEGORIES, IF THE NUMBERS OF THE SELECTED CATEGORIES MATCH ANY PRODUCT CATEGORY NUMBERS STORED IN SPACES IN THE BINGO CARD, THOSE SPACES WILL BE REVEALED. IF YOU MATCH FIVE SPACES IN A ROW, EITHER HORIZONTALLY, VERTICALLY, OR DIAGONALLY, OR IF ALL FOUR CORNERS ARE MATCHED, YOU HAVE WON A PRIZE OF $1,000.00. IF YOU MATCH ALL EIGHT SELECTED CATEGORIES TO FORM AN "X" ALONG WITH

THE FREE SPACE. YOU ARE A GRAND PRIZE WINNER OF $10,000.00! IN ANY EVENT, AVAILABLE FOR PRINTING ON YOUR PRINTER WILL BE COUPONS AND REFUND OFFERS FOR PARTICIPATING MANUFACTURERS IN THE SELECTED PRODUCT CATEGORIES ALONG WITH AN INDIVIDUALLY PERSONALIZED PRINTED REFUND/REBATE FORM FOR SUBMITTING UPC CODES AND CASH REGISTER RECEIPTS IN ORDER TO GET CASH BACK OR OTHER REWARDS FOR EACH SELECTED PARTICIPATING MANUFACTURER'S PRODUCTS PURCHASED.

At block 75, the consumer selects eight of the product categories 47, as shown in FIG. 4. At block 82, the CPU 2 randomly generates the category numbers associated with the Bingo spaces 44 and then compares the selected category numbers 48 against those in the Bingo spaces 44 and removes the "cover" dollar sign 46 from any of the Bingo spaces 44 which match selected product category numbers 48. It should be noted that, for ease of illustration only, each of the revealed Bingo spaces 44 in FIGS. 4 and 5 matches a respective one of the first 30 category numbers 48 as shown. In reality, 100 or more categories can be scrolled through and the categories in the Bingo spaces 44 would be randomly selected from the entire 100 categories. At block 83, the CPU 2 determines if the selected category numbers 48 yield a winning combination. For example, four of the selected categories 47 may match categories in the Bingo spaces 44 as illustrated in FIG. 4 to make a winning diagonal line. If the answer is YES, at block 85, a message 54 is flashed in the prize display area 53 on the screen display 4. The message 54 can read, for example:

YOU HAVE JUST WON $1000.00!!

Also, at block 85, a menu 90 (FIG. 4) is displayed in a payment window 91 to allow the consumer to select the preferred method of payment from a variety of payment methods. For example, an electronic funds transfer can be made to the consumer's bank account, a credit balance can be added to the consumer's credit card, a gift certificate or credit voucher can be generated for a participating retailer, or a check can be issued and mailed directly to the consumer. Of course, as an alternative to cash, winning combinations can be rewarded with free merchandise from participating retailers or manufacturers. At block 92, payment is made in the selected manner. Alternatively, if no winning combination is detected, at block 93, a consolation message, such as the message 93 in FIG. 5 is generated as all of the Bingo spaces 44 are revealed.

Finally, whether or not a winning combination is achieved, at block 95, the CPU 2 prompts the consumer to select specific products from the selected categories 47 for which discount coupon and/or rebate information is desired. At block 96, the CPU 2 sends data to the personal computer 15 which will allow it to print discount coupons and rebate information on the printer 25 for the selected products from the product categories 47. Also, at block 96, a rebate custom personalized rebate form similar to a form 101 in FIG. 8 can be sent to the personal computer 15 by the CPU 2 for printing on the printer 25. At block 97 the coupons, rebate offers and the personalized form 101 are printed out (or stored for later printing) by the personal computer 15.

If Keno is the match game being used, in the method of FIG. 2, instead of the Bingo determination of block 82, at block 98, the CPU 2 randomly generates a combination of twenty numbers from the Keno numbers 1–80 and then checks to see if any of the eight numbers 48 of the selected categories 47 match the randomly generated numbers 65 in the Keno game 62 and a total number of matches is generated. Then, at block 83, again, the CPU 2 determines the prize value, if any, of the number of matches. For example, a minimum of five matches might be required for an initial level prize of $50, as shown at message 99 in FIG. 7. The prize value can then increase, again as an example only, by a factor of 10 for each additional match to a grand prize of $50,000 if all eight selected categories match the categories in the Keno game 62. Selection of the prize payment method, printing of coupons and rebate offers and the printing of the rebate form 101 is then accomplished as indicated in blocks 85, 92, 95, 96 and 97, as described above. Although a Keno game has been described where 20 numbers are randomly generated out of 80, it should be noted that fewer, or more numbers can be generated depending upon the desired odds to win.

As a final step in the method, as indicated at block 100, the consumer submits the personalized form, along with proofs of purchase for some or all of the selected products to a fulfillment center for rebate processing. The form and the proofs of purchase can be mailed in or electronically scanned, such as by the scanner 27.

Instead of requiring the consumer to select products after playing the game once, as indicated at block 95, they can be given the option to play multiple games, selecting products only when all game play is finished.

Figure 8:
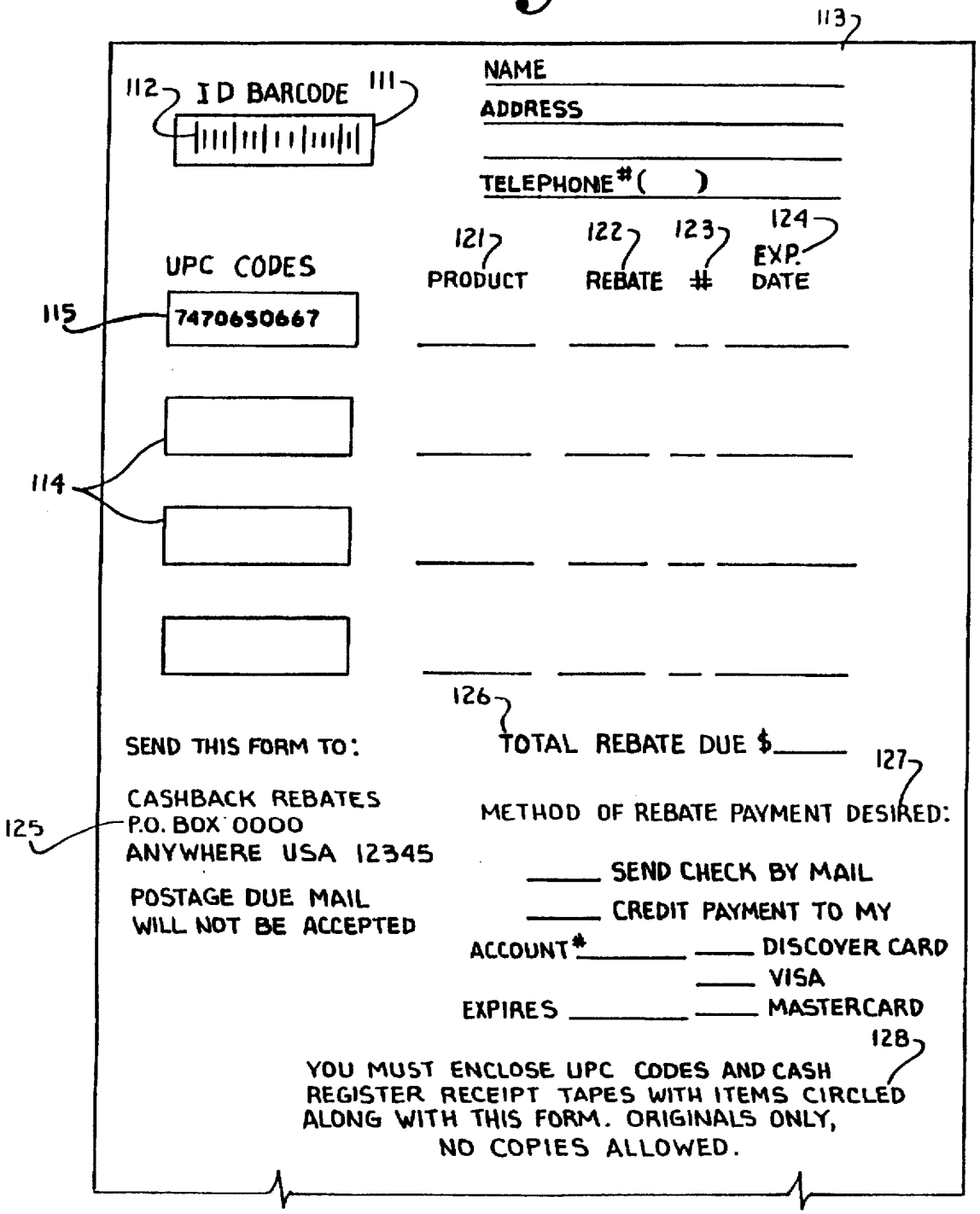
FIG. 8 is a custom personalized rebate form for downloading and printing at remote sites.

Referring to FIG. 8, the personalized rebate form 101, for use with the methods of FIGS. 1 and 2, is illustrated. The form 101 includes a strip 111 at the top thereof, in which a optional bar code 112 with a consumer ID number can be printed. The bar code 112 is preferably printed in a manner similar to standard scannable bar codes. In addition, or as an alternative, block 113 is provided for pre-printing or hand printing of the consumer's name, address and telephone number.

On the left below the strip 111 is an area 114 for UPC code numbers, such as the number 115, from selected participating products. For the consumer's convenience, a plurality of columns 121–124 are provided immediately to the right of the UPC code number 114. The column 121 is for the printed product name and the column 122 is for the rebate value associated with the product, e.g. "$1.00". The column 123 is for the number of products required for the rebate, e.g. "2 boxes". The column 124 is an expiration date, if any, for the promotion. The address for the redemption center is printed at block 125. A block 126 is reserved for totalling up the rebate due while a block 127 is used to indicate the desired method of payment, i.e. check by mail or electronic funds transfer to one of several credit cards. Since electronic funds transfer would be much more economical for the sponsor, this option can be encouraged by the use of incentives, such as additional rebates given by the credit card companies, for example. Finally, an instruction message 128 can be provided to remind the player of the necessary enclosures for a rebate to be issued. As mentioned above, as an alternative to mailing the form 101 and the proofs of purchase such as cash register receipts, the consumer can use an electronic scanner such as the scanner 27 to electronically scan them in to the CPU 2. Thus, if electronic funds transfer is selected as the rebate payment method in the block 127 on the form 101, and if the form and the proofs of purchase are electronically scanned in, then the entire rebate transaction can occur electronically.

The inventive method is very flexible in that it can be adapted for different markets, regions, or countries.

Furthermore, multiple programs can be run simultaneously for different promotions. Match games can be sponsored by different manufacturers or retailers and ads can be displayed on the display screens adjacent to the match game display. Alternatively, ads or logos can be placed over the game matrix spaces as a mosaic in lieu of the dollar signs.

The inventive product promotion method is adaptable to any type of product or service such as automobile rebates, cellular or long distance telephone service promotions, travel related services or cable television channel promotions.

Although a Bingo game 41 and a Keno game 62 have been illustrated as match games for the inventive consumer product promotion method, other match games or games of chance can be used as well. The numbers and types of product categories 47 suggested herein, as well as the prize values and winning combinations, are for example only and are not intended to be limiting. The form 101 is illustrative only and, clearly, other arrangements of fields could be designed which are equally effective.

It is thus to be understood that while certain forms of the present invention have been illustrated and described herein, it is not to be limited to the specific forms or arrangement of parts described and shown.

What is claimed and desired to be secured by Letters Patent is as follows:

1. An interactive consumer product promotion method for providing product promotion information to a consumer at an interactive electronic display from a remote consumer product database, comprising the steps of:

a. electronically interconnecting said interactive electronic display with said database;

b. displaying, on said interactive electronic display, a display screen from said database, said display screen including a plurality of product categories, at least some of which include one or more consumer products fitting that category;

c. prompting the selection by the consumer, via said interactive electronic display, of a plurality of the displayed categories and allowing the consumer to select one or more products within each selected category which includes consumer products for discount coupons or rebate offers for consumer products within the selected categories; and d. downloading said discount coupons and/or rebate offers from said database to said interactive electronic display for storage or printing.

2. A method as in claim 1, wherein said database is located at an Internet site and said electronic connecting step comprises connecting said interactive electronic display and said database via the Internet.

3. A method as in claim 1, and further comprising the steps of:

a. creating a personalized rebate form with specific rebate information from the products selected by the consumer for collective submission of multiple proofs of purchase of the selected products for rebate; and b. downloading said personalized rebate form from said database to said interactive display for storing or printing.

4. A method as in claim 3, wherein said rebate form creating step includes providing a plurality of payment options on said form for selection by the consumer, including electronic funds transfer.

5. A method as in claim 4, and further comprising the steps of:

a. submitting said personalized form and said proofs of purchase by electronically scanning them into said database via said interactive display.

6. An interactive consumer product promotion method for providing product promotion information to a consumer at an interactive electronic display from a remote consumer product database, said database including a match game in which spaces on said match game are associated with respective product categories, said method comprising the steps of:

a. electronically interconnecting said interactive electronic display with said database;

b. displaying, on said interactive electronic display, a display screen from said database, said display screen including a plurality of product categories, at least some of said categories including one or more consumer products fitting that category;

c. displaying said match game on said interactive electronic display along with the product categories;

d. prompting the selection by the consumer, via said interactive electronic display, of one or more of the displayed categories and allowing the consumer to select one or more products within each selected category which contains products for discount coupons or rebate offers;

e. determining whether the selected categories make a winning combination on said match game; and f. downloading said discount coupons and/or rebate offers from said database to said interactive electronic display for storage or printing.

7. A method as in claim 6, wherein said match game is a Bingo game with a matrix of said spaces including a number of product category spaces with each said product category space associated with a respective product category, and wherein said matrix may also include one or more free spaces, said method further comprising the steps of:

a. initially displaying said Bingo game on said interactive electronic display with said spaces covered; and b. revealing matches by uncovering product category spaces associated with respective product categories which match said selected product categories and by also uncovering any free space or spaces.

8. A method as in claim 7, and further comprising the steps of:

a. calculating the value of any prizes earned by matches between said selected product categories and product categories associated with said Bingo spaces; and b. displaying the value of any prizes on said interactive electronic display.

9. A method as in claim 8, and further comprising the steps of:

a. displaying an interactive menu of prize reimbursement alternatives; and b. prompting a consumer to select one of said prize redemption alternatives to collect a prize.

10. A method as in claim 6, wherein said match game is a Keno game with a matrix of Keno numbers in said spaces and with each said product category being associated with a number, said method further comprising the steps of:

a. initially displaying said Keno game on said interactive electronic display with no numbers highlighted;

b. randomly selecting a plurality of Keno numbers equal to or greater than the number of product categories selected; and c. highlighting both said randomly selected Keno numbers and the numbers of said selected product categories such that matches between said selected Keno numbers and said selected product category numbers are revealed.

11. A method as in claim 10, and further comprising the steps of:

a. calculating the value of any prizes earned by matches between said selected product categories and said Keno spaces; and b. displaying the value of any prizes on said interactive electronic display.

12. A method as in claim 11, and further comprising the steps of:

a. displaying an interactive menu of prize reimbursement alternatives; and b. prompting a consumer to select one of said prize redemption alternatives to collect a prize.

13. An interactive consumer product promotion method for providing product promotion information to an interactive electronic display from a remote consumer product database, said database including a match game in which spaces on said match game are associated with respective product categories, comprising the steps of:

a. electronically interconnecting said interactive electronic display with said database;

b. displaying, on said interactive electronic display, a display screen from said database, said display screen including a plurality of product categories and said match game;

c. prompting the selection, via said interactive electronic display, of one or more of the displayed categories for discount coupons or rebate offers for consumer products within the selected category or categories;

d. determining whether the selected categories make a winning combination on said match game;

e. prompting the selection of individual products within said selected product categories; and f. downloading said discount coupons and/or rebate offers for said selected individual products to said interactive electronic display for storage or printing.

14. A method as in claim 13, wherein said database is located at an Internet site and said electronic connecting step comprises connecting said interactive electronic display and said database via the Internet.

15. A method as in claim 13, wherein said match game is a Bingo game with a matrix of said spaces including a number of product category spaces with each said product category space associated with a respective product category, and wherein said matrix may also include one or more free spaces, said method further comprising the steps of:

a. initially displaying said Bingo game on said interactive electronic display with said spaces covered; and b. revealing matches by uncovering product category spaces associated with respective product categories which match said selected product categories and by also uncovering any free space or spaces.

16. A method as in claim 15, and further comprising the steps of:

a. calculating the value of any prizes earned by matches between said selected product categories and product categories associated with said Bingo spaces; and b. displaying the value of any prizes on said interactive electronic display.

17. A method as in claim 16, and further comprising the steps of:

a. displaying an interactive menu of prize reimbursement alternatives; and b. prompting a consumer to select one of said prize redemption alternatives to collect a prize.

18. A method as in claim 13, wherein said match game is a Keno game with a matrix of Keno numbers in said spaces and with each said product category being associated with a number, said method further comprising the steps of:

a. initially displaying said Keno game on said interactive electronic display with no numbers highlighted;

b. randomly selecting a plurality of Keno numbers equal to or greater than the number of product categories selected; and c. highlighting said randomly selected Keno numbers such that matches between said selected Keno numbers and said selected product category numbers are revealed.

19. A method as in claim 18, and further comprising the steps of:

a. calculating the value of any prizes earned by matches between said selected product categories and said Keno spaces; and b. displaying the value of any prizes on said interactive electronic display.

20. A method as in claim 19, and further comprising the steps of:

a. displaying an interactive menu of prize reimbursement alternatives; and b. prompting a consumer to select one of said prize redemption alternatives to collect a prize.

21. A method as in claim 13, and further comprising the steps of:

a. creating a personalized rebate form with specific rebate information from the products selected by the consumer for collective submission of multiple proofs of purchase of the selected products for rebate; and b. downloading said personalized rebate form from said database to said interactive display for storing or printing.

22. A method as in claim 21, wherein said rebate form creating step includes providing a plurality of payment options on said form for selection by the consumer, including electronic funds transfer.

23. A method as in claim 22, and further comprising the steps of:

a. submitting said personalized form and said proofs of purchase by electronically scanning them into said database via said interactive display.

24. An interactive consumer product promotion method for providing product promotion information to an interactive electronic display from a remote consumer product database, said database including a Bingo game with a matrix of spaces including a number of product category spaces with each said product category space associated with a respective product category, and wherein said matrix may also include one or more free spaces, said method comprising the steps of:

a. electronically interconnecting said interactive electronic display with said database;

b. displaying, on said interactive electronic display, a display screen from said database, said display screen including a plurality of product categories and said Bingo game with said spaces initially covered;

c. prompting the selection, via said interactive electronic display, of a predetermined number of the displayed categories for discount coupons or rebate offers for consumer products within the selected category or categories;

d. revealing matches by uncovering product category spaces associated with respective product categories which match said selected product categories and by also uncovering any free space or spaces;

e. determining whether the selected categories make a winning combination on said Bingo game;

f. prompting the selection of individual products within said selected product categories; and g. downloading said discount coupons and/or rebate offers from said database to said interactive electronic display for storage or printing.

25. A method as in claim 24, wherein said database is located at an Internet site and said electronic connecting step comprises connecting said interactive electronic display and said database via the Internet.

26. A method as in claim 24, and further comprising the steps of:

a. calculating the value of any prizes earned by matches between said selected product categories and product categories associated with said Bingo spaces; and b. displaying the value of any prizes on said interactive electronic display.

27. A method as in claim 26, and further comprising the steps of:

a. displaying an interactive menu of prize reimbursement alternatives; and b. prompting a consumer to select one of said prize redemption alternatives to collect a prize.

28. A method as in claim 24, and further comprising the steps of:

a. creating a personalized rebate form with specific rebate information from the products selected by the consumer for collective submission of multiple proofs of purchase of the selected products for rebate; and b. downloading said personalized rebate form from said database to said interactive display for storing or printing.

29. A method as in claim 28, wherein said rebate form creating step includes providing a plurality of payment options on said form for selection by the consumer, including electronic funds transfer.

30. A method as in claim 29, and further comprising the steps of:

a. submitting said personalized form and said proofs of purchase by electronically scanning them into said database via said interactive display.

* * * * *

UNITED STATES PATENT AND TRADEMARK OFFICE

CERTIFICATE OF CORRECTION

PATENT NO. : 5,791,991
DATED : August 11, 1998

INVENTOR(S) : Maynard E. Small

It is certified that error appears in the above-identified patent and that said Letters Patent is hereby corrected as shown below:

Drawings:

Delete Figs. 2-8, and substitute therefor Figs. 2-8, as shown on the attached pages.

Signed and Sealed this

Twenty-ninth Day of December, 1998

*Attest:*

Bruce Lehman

BRUCE LEHMAN

*Attesting Officer*

*Commissioner of Patents and Trademarks*

53 54

"YOU HAVE JUST WON $1,000!"

CASHBACK BINGO™

| | | | | |
|---|---|---|---|---|
| $ | $ | $ | $ | 6 |
| $ | $ | $ | 28 | $ |
| $ | $ | FREE SPACE | $ | $ |
| $ | 24 | $ | $ | $ |
| 1 | $ | $ | $ | $ |

SELECT 8 CATEGORIES

| | | | |
|---|---|---|---|
| 1 | 6 | 9 | 12 |
| 15 | 22 | 24 | 28 |

91 90

CHOOSE PAYMENT METHOD FOR CASHBACK BINGO
MAIL CHECK | EFT TO BANK | PAY CREDIT CARD ACCOUNT

From the list below, select eight (8) categories to play CASHBACK BINGO and to receive discount and/or rebate/refund information.

1. AIR FRESHENERS
2. AUTO PRODUCTS
3. BATHROOM TISSUES
4. CANDY
5. CAT FOOD
6. CEREALS
7. CHEESE
8. COFFEE
9. CRACKERS
10. DENTAL CARE
11. DETERGENTS, LAUNDRY
12. DIAPERS
13. DOG FOODS
14. FILM
15. HOSIERY
16. ICE CREAM
17. JUICES, FROZEN
18. LIGHT BULBS
19. PAIN REMEDIES
20. PASTA
21. PIZZA
22. PLASTIC WRAP
23. SHAMPOO
24. SNACKS
25. SOAPS, BATH
26. SODA
27. SOUP
28. TRASH BAGS
29. VEGGIES, CANNE
30. VITAMINS

IF YOUR SELECTIONS MATCH A COMPLETE ROW ON THE GAME CARD VERTICAL DIAGONALLY, OR HORIZONTALLY, YOU ARE A CASHBACK BINGO WINNER!

*Fig. 4.*

93

BETTER LUCK NEXT TIME!
SEE SAVINGS

CASHBACK BINGO™

| | | | | |
|---|---|---|---|---|
| 8 | 17 | 16 | 6 | 7 |
| 3 | 18 | 4 | 28 | 23 |
| 14 | 29 | FREE SPACE | 15 | 13 |
| 20 | 24 | 26 | 11 | 2 |
| 1 | 9 | 27 | 22 | 5 |

SELECT 8 CATEGORIES

| | | | |
|---|---|---|---|
| 1 | 6 | 9 | 12 |
| 15 | 22 | 24 | 28 |

From the list below, select eight (8) categories to play CASHBACK BINGO and to receive discount and/or rebate/refund information.

1. Air Fresheners
2. Auto Products
3. Bathroom Tissues
4. Candy
5. Cat Food
6. Cereals
7. Cheese
8. Coffee
9. Crackers
10. Dental Care
11. Detergents, Laundry
12. Diapers
13. Dog Foods
14. Film
15. Hosiery
16. Ice Cream
17. Juices, Frozen
18. Light Bulbs
19. Pain Remedies
20. Pasta
21. Pizza
22. Plastic Wrap
23. Shampoo
24. Snacks
25. Soaps, Bath
26. Soda
27. Soup
28. Trash Bags
29. Veggies, Canned
30. Vitamins If your selections match a complete row on the game card vertically, diagonally, or horizontally, you are a CASHBACK BINGO winner!

*Fig.5.*

99

"YOU HAVE JUST WON $50!!"
NUMBER OF MATCHES: 5

CASHBACK KENO™

| | | | | | | | | | |
|---|---|---|---|---|---|---|---|---|---|
| **1** | 2 | 3 | 4 | **5** | 6 | 7 | 8 | **9** | 10 |
| 11 | **12** | **13** | 14 | 15 | 16 | 17 | 18 | 19 | 20 |
| 21 | **22** | 23 | 24 | 25 | 26 | 27 | **28** | 29 | 30 |
| 31 | 32 | 33 | 34 | **35** | 36 | **37** | 38 | 39 | 40 |

| | | | | | | | | | |
|---|---|---|---|---|---|---|---|---|---|
| 41 | 42 | **43** | 44 | 45 | **46** | 47 | 48 | 49 | 50 |
| **51** | 52 | 53 | **54** | 55 | 56 | 57 | 58 | **59** | 60 |
| 61 | **62** | **63** | 64 | 65 | 66 | 67 | **68** | 69 | 70 |
| 71 | 72 | 73 | **74** | 75 | 76 | **77** | 78 | **79** | 80 |

SELECT 8 CATEGORIES [1] [6] [9] [12] [15] [22] [24] [28]

From the list below, select eight (8) categories to play *CASHBACK KENO* and to receive discount and/or rebate/refund information.

1. AIR FRESHENERS
2. AUTO PRODUCTS
3. BATHROOM TISSUES
4. CANDY
5. CAT FOOD
6. CEREALS
7. CHEESE
8. COFFEE
9. CRACKERS
10. DENTAL CARE
11. DETERGENTS, LAUNDRY
12. DIAPERS
13. DOG FOODS
14. FILM
15. HOSIERY
16. ICE CREAM
17. JUICES, FROZEN
18. LIGHT BULBS
19. PAIN REMEDIES
20. PASTA
21. PIZZA
22. PLASTIC WRAP
23. SHAMPOO
24. SNACKS
25. SOAPS, BATH
26. SODA
27. SOUP
28. TRASH BAGS
29. VEGGIES, CANNED
30. VITAMINS

IF 5 OR MORE OF YOUR SELECTIONS MATCH SELECTIONS ON THE GAME CARD, YOU ARE A *CASHBACK KENO* WINNER!

*Fig. 7.*

US005791991C1

(12) EX PARTE REEXAMINATION CERTIFICATE (8118th)

United States Patent

Small

(10) Number: US 5,791,991 C1

(45) Certificate Issued: Mar. 29, 2011

(54) INTERACTIVE CONSUMER PRODUCT PROMOTION METHOD AND MATCH GAME

(75) Inventor: Maynard E. Small, Kansas City, MO (US)

(73) Assignee: Internet Coupon Solutions LLC, Frisco, TX (US)

Reexamination Request:
No. 90/010,755, Dec. 3, 2009

Reexamination Certificate for:

| | |
|---|---|
| Patent No.: | **5,791,991** |
| Issued: | **Aug. 11, 1998** |
| Appl. No.: | **08/559,798** |
| Filed: | **Nov. 15, 1995** |

Certificate of Correction issued Dec. 29, 1998.

(51) Int. Cl.
*A63F 3/06* (2006.01)

(52) U.S. Cl. ..... 463/41; 463/40; 463/42

(58) Field of Classification Search ..... None
See application file for complete search history.

(56) References Cited

U.S. PATENT DOCUMENTS

| | | | |
|---|---|---|---|
| 4,674,041 | A | 6/1987 | Lemon et al. |
| 4,882,675 | A | 11/1989 | Nichtberger et al. |
| 5,227,874 | A | 7/1993 | Von Kohorn |
| 5,559,936 | A | 9/1996 | Poulter et al. |
| 5,682,525 | A | 10/1997 | Bouve et al. |
| 5,710,886 | A | 1/1998 | Christensen et al. |
| 5,727,164 | A | 3/1998 | Kaye et al. |
| 5,774,869 | A | 6/1998 | Toader |
| 5,791,991 | A | 8/1998 | Small |
| 6,321,208 | B1 | 11/2001 | Barnett et al. |

OTHER PUBLICATIONS

INFOWORLD, "Home Shopping Service Comes to the Internet," May 23, 1994, p. 53.

*Primary Examiner*—Fred Ferris

(57) ABSTRACT

An interactive consumer product promotion method and match game includes a database which is accessed for an information screen displayed on an interactive electronic terminal, such as a personal computer, interactive television, in-store kiosk, etc. The displayed information screen typically includes a listing of popular consumer product categories, such as "Detergents"; "Cereals"; "Motor Oil"; "Cookies"; "Crackers"; etc. along with a matrix of spaces representing a match game such as Bingo or Keno. In each space in the displayed matrix a symbol is displayed. The game is played by comparing selected consumer product categories with preselected spaces on the matrix to detect matches and corresponding prizes. Coupons and/or rebate offers for products with the selected categories are downloaded for printing by the consumer. A personalized rebate form can be printed which allows the consumer to collectively submit multiple register receipts and/or UPC codes for selected products, via mail or electronic scanning, in order to secure a single combined electronic or mailed rebate payment.

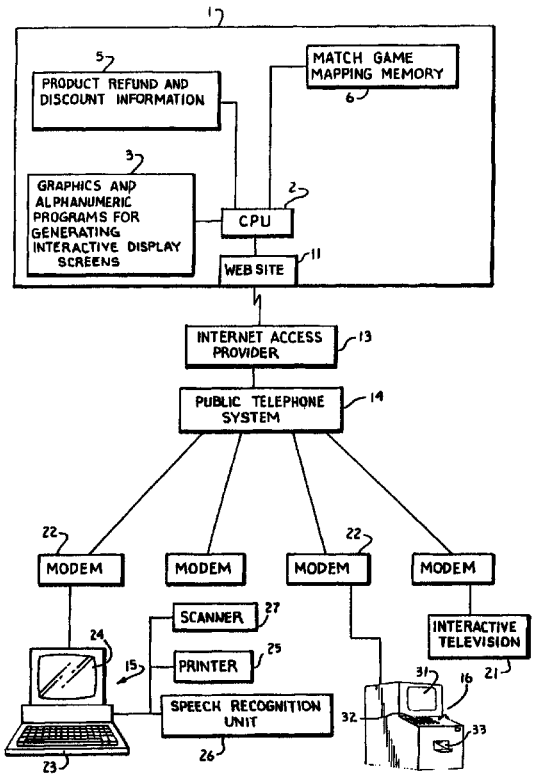

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 2 are cancelled.

Claims 3-30 were not reexamined.

* * * * *